United States Patent [19]

Predmore

[11] 4,025,878

[45] May 24, 1977

[54] WAVEGUIDE COUPLER HAVING HELICALLY ARRANGED COUPLING SLOTS

[75] Inventor: Clayton Read Predmore, Amherst, Mass.

[73] Assignee: Associated Universities, Inc., Charlottesville, Va.

[22] Filed: Mar. 8, 1976

[21] Appl. No.: 664,940

[52] U.S. Cl. ..... 333/10; 333/21 R

[51] Int. Cl.[2] ..... H01P 5/18

[58] Field of Search ..... 333/10, 21 R

[56] References Cited

UNITED STATES PATENTS 2,963,663 12/1960 Marcatili ..... 333/10 X

FOREIGN PATENTS OR APPLICATIONS 1,391,915 4/1975 United Kingdom ..... 333/10

*Primary Examiner*—Paul L. Gensler

*Attorney, Agent, or Firm*—Watson, Cole, Grindle & Watson

[57] ABSTRACT

A waveguide coupler for coupling energy between two different waveguides through a coupling of their magnetic fields. Each of the waveguides, between which coupling is to take place, is capable of supporting electromagnetic waves having different phase velocities. The first waveguide has a circular cross section and is shaped and dimensioned so as to support a $TE_{mn}$ or a $TM_{mn}$ mode of wave propagation. A further length of waveguide, such as one having a rectangular cross section, is capable of supporting a different order mode of wave propagation. The wave supported within the rectangular waveguide has a higher phase velocity than that supported within the circular waveguide. The rectangular waveguide is helically wrapped around the outer surface of the circular waveguide in such a manner that the longitudinal fields of the electromagnetic waves are coupled between the two waveguides through a plurality of apertures which are provided within both waveguides along their contacting helical path.

16 Claims, 9 Drawing Figures

WAVEGUIDE COUPLER HAVING HELICALLY ARRANGED COUPLING SLOTS

BACKGROUND OF THE INVENTION

The present invention is concerned with coupling of electromagnetic waves between rectangular waveguides and circular waveguides through the magnetic fields of such waves.

Coupling of such electromagnetic waves, between the $TE_{10}$ mode in the rectangular waveguide and the $TE_{01}$ mode in a circular waveguide has generally been accomplished in the past by arranging the waveguides in contact with each other with the longitudinal axes of both waveguides aligned in parallel. With such a coupling arrangement, the dimensions of the rectangular and circular waveguides must be selected so that the two modes to be coupled have the same phase velocity. The two waveguides are then provided with a plurality of coupling apertures along their common contacting wall. This type of coupling arrangement is illustrated in the U.S. patents to Unger, U.S. Pat. No. 3,184,695, and Miller, U.S. Pat. No. 3,529,205.

When the phase velocities of the waves supported within the two waveguides have been different, couplers have been built in which the longitudinal axes of the two waveguides have remained in a parallel relationship but a periodic phasing or periodic spacing has been provided in the coupling apertures. This approach has been discussed in a paper presented by S. E. Miller in *Bell Systems Technical Journal*, Volume 47, October 1968, pages 1801–1822, entitled "On Solutions for Two Waves With Periodic Coupling".

An alternative approach which has been utilized for making transitions of electromagnetic waves between rectangular and circular waveguides is illustrated in the patents to Walker, U.S. Pat. No. 2,766,432 and Marcatili, U.S. Pat. No. 2,963,663. In the coupling arrangement illustrated by the patent to Walker, for example, the electromagnetic waves of the two waveguides are coupled through their transverse fields. The rectangular waveguide is wrapped around the circular waveguide with a plurality of coupling apertures being provided along the common wall, with the apertures being spaced by one wavelength. Since it is the transverse fields which are being coupled, the rectangular waveguide must be arranged with its wider wall in contact with the circular waveguide since this is the location of its transverse field component. When forming the waveguide coupler in such a manner, if it becomes desirable to provide additional coupling apertures than would be permitted by one turn of the rectangular waveguide around the circular waveguide, it is possible for the rectangular waveguide to be wrapped in a spiral direction around the circular waveguide, as pointed out in the patent to Walker (in column 3, lines 22 through 45).

While it would be desirable to provide a coupler arrangement for coupling the electromagnetic waves via their magnetic fields in an efficient manner without high degrees of loss and additionally to provide a coupler which would not consume a great deal of space, none of the previously utilized arrangements enable such results to be achieved. Where the couplers are arranged with their longitudinal axis in parallel, large lengths of couplers are required, on the order of 1.5 meters, such couplers generally tend to be narrow band and to have a low power transfer efficiency.

SUMMARY OF THE INVENTION

An object of the present invention is to provide a waveguide coupler for coupling electromagnetic waves between waveguides via their longitudinal magnetic fields in such a manner so as to reduce the over-all length of the coupler and the attenuation during such coupling as compared to previously known couplers as discussed above.

Another object of the present invention is to provide a waveguide coupler for efficiently coupling energy between a rectangular waveguide and a circular waveguide via the magnetic field of the rectangular $TE_{10}$ mode and circular $TE_{mn}$ mode.

These objectives are achieved in accordance with the present invention by providing a waveguide coupler in which a rectangular waveguide is helically wrapped around the outer wall of a circular waveguide, with the narrow wall of the rectangular waveguide in contact with the circular waveguide for the transfer of energy between the magnetic fields of the two waveguides. The circular waveguide is shaped and dimensioned so as to be capable of supporting a $TE_{mn}$ mode (generally a $TE_{on}$ mode) of wave propagation and the rectangular waveguide is shaped and dimensioned so as to be capable of supporting a different order mode of wave propagation ($TE_{no}$). Furthermore, the rectangular waveguide is capable of supporting waves having a higher phase velocity than the circular waveguide. The portions of the two waveguides in contact are provided with a plurality of coupling apertures which open into the interior of the waveguides so as to enble coupling of energy between the two waveguides.

With utilizing such an arrangement, a coupler is provided which is capable of transferring electromagnetic waves from the $TE_{no}$ mode (generally the $TE_{10}$ mode) in the rectangular waveguide to the $TE_{on}$ circular symmetric modes in the circular waveguide when the two waveguides have different phase velocities. The difference in the phase velocities is a result of the different cutoff frequencies in the waveguides. The relationship between phase velocity $v_{pi}$, cutoff frequency $f_{ci}$ ($i = 1$ or 2), and signal frequency, $f$, is as follows:

$$v_{pi} = c[1-(f_{ci}/f)^2]^{-1/2} \quad (1)$$

where $c$ is the free-space velocity of an electromagnetic wave in air. The waveguide with the higher cutoff frequency, therefore, has the greater phase velocity.

The helical wrapping of the rectangular waveguide around the circular waveguide enables the coupling to be brought into proper phase when the rectangular waveguide has the higher phase velocity. Thus, for the $TE_{01}$ mode in the circular waveguide with an inner diameter of D, the cutoff frequency is:

$$f_{c1} = \frac{3.841c}{\pi \cdot D} = \frac{366.8GHz}{D\ (\text{mm})} \quad (2)$$

Where $c = 2.997 \times 10^8$ m/sec(air). Likewise for the $TE_{10}$ mode in the rectangular waveguide with a width A for its wider wall, the cutoff frequency is:

$$f_{c2} = \frac{c}{2 \cdot A} = \frac{150GHz}{A\ (\text{mm})} \quad (3)$$

The lead or pitch, of the helix is chosen so that at a design frequency of $f_o$:

$$l = \pi(D+A+2T)\,(f_o^2 - f_{c2}^2)^{1/2} / (f_{c2}^2 - f_{cl}^2)^{1/2} \quad (4)$$

where $T$ is the thickness of the wall between the rectangular and circular waveguides.

The helical pattern has the additional advantage of discriminating against noncircular symmetric modes since this spurious coupling is split between the two polarizations and is not likely to be in phase with the peaks of the spurious modes pattern. To further achieve this discrimination against the undesirable modes, the apertures are provided with an oval, or slotted, shape, with their major axes being parallel to the longitudinal axis of the circular waveguide.

It is generally desirable with such a coupling arrangement to utilize a rectangular waveguide which has a much smaller cross sectional area than the circular waveguide. For coupling to the $TE_{01}$ circular waveguide mode, the ratio between the cross sectional area of the two waveguides is given by the following approximation:

$$A_o/A_{\square} \geqq 9.4 \quad (5)$$

Furthermore, since it is possible with such a coupling arrangement to utilize the larger circular waveguide, the losses which arise when utilizing small circular waveguides are inherently avoided. While large circular waveguides are utilized for transmission purposes, in the previous systems it was necessary to taper down the large circular waveguide to a small circular waveguide prior to coupling with the rectangular waveguide. With utilizing the helical coupling arrangement of the present invention for coupling the magnetic fields of the two waveguides such tapering of the circular waveguide is entirely unnecessary thereby avoiding the losses due to such tapering.

Utilizing the helical coupling arrangement of the present invention also makes it possible to select waves of a specific frequency to be transferred between the two waveguides. In contrast, in previous waveguide coupling systems where the phase velocities are matched, a broad band coupling was provided and hence discrimination against undesirable frequencies had to be accomplished by the provision of additional means.

In the preferred embodiment, the rectangular waveguide can be formed by milling a groove of rectangular cross section along a helical path in the outer wall of the circular waveguide. The initial end of this groove would then be connected to an input rectangular waveguide and the terminating end of the groove to an output rectangular waveguide. The groove is tapered at both ends for receiving the input and output rectangular waveguides. A thin metal plate, which provides a good rf seal on the interface, is utilized to cover the groove thereby completing the rectangular waveguide. The coupling apertures are then uniformly spaced along the path of the helix in the thin common wall between the circular and rectangular waveguides. These coupling apertures are spaced apart in the axial direction of the circular waveguide by a distance substantially equal to an odd multiple (e.g., 1, 3, 5 . . . ) of a quarter of the wave length of the wave to be supported by the circular waveguide and are spaced apart in the direction of the helix by a distance substantially equal to an odd multiple of a quarter of the wave length of the wave to be supported in the helically wrapped rectangular waveguide.

Thus, in utilizing the helical coupler of the present invention, an efficient and compact coupler for coupling energy between rectangular waveguides and circular waveguides can be obtained. The overall distance required for such a coupling arrangement is on the order of 0.5 meters.

A helical waveguide coupler can also be utilized for frequency selectivity in conjunction with a small diameter circular waveguide for providing stronger coupling. This concept can be used as a channel-dropping filter in a repeater station of a $TE_{01}$ communication transmission system. Furthermore, since the helical coupler can couple from a rectangular waveguide to any circularly symmetric $TE_{on}$ mode in a circular waveguide which is above cutoff, this coupler can be used to excite $TE_{on}$ modes in circular waveguides or to monitor the generation of $TE_{on}$ modes by other components.

The helical coupler can also be utilized in forming part of a sequential band separator for the coupling of a plurality of bands of frequencies from a circular waveguide. In such an arrangement, at least two rectangular waveguides would be helically wrapped around the circular waveguide. The helical path of each of the rectangular waveguides would have a different angle so that the rectangular waveguides each couple different bands of frequencies. Each rectangular waveguide and its helical path would be formed in the same manner as when utilizing a single coupling arrangement as previously discussed above.

In summary, the helical waveguide coupler provides additional flexibility in the design of couplers and mode exciters for circular waveguide transmission systems.

DESCRIPTION OF THE PREFERRED EMBODIMENTS

Figure 1:
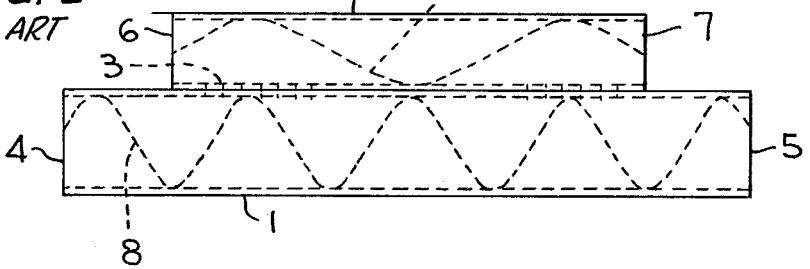
FIG. 1 PRIOR ART
FIG. 1 is a side elevational view of a waveguide coupler for coupling waves between a rectangular waveguide and a circular waveguide in accordance with the prior art.

The known waveguide coupler for coupling electromagnetic waves between a circular waveguide and a rectangular waveguide through their longitudinal magnetic fields, as previously discussed, is illustrated in FIG. 1. The waveguide coupler illustrated includes a circular waveguide 1 which is capable of supporting a $TE_{on}$ mode of wave propagation, where $n$ is a whole number referring to the number of radial variations of the electric field in the waveguide. A rectangular waveguide 2, which is capable of supporting the $TE_{10}$ mode of wave propagation, is aligned in contact with circular waveguide 1. Both waveguides are arranged so that their longitudinal axes are aligned in parallel. The narrow wall of rectangular waveguide 2 is placed in contact with the circular waveguide so that coupling between the waveguides occur through their magnetic fields.

Circular waveguide 1 has an input port 4 and an output port 5. Rectangular waveguide 2 has an input port 6 connected to a matched load (not shown) and an output port 7. Two groups of four coupling apertures 3 are provided between the attached portions of the circular and rectangular waveguides. The distance between each of coupling apertures 3 in each group is approximately a quarter of the wavelength of a wave to be coupled from circular waveguide 1 into rectangular waveguide 2.

A diagrammatic representation of the electromagnetic waves in circular waveguide 1 and rectangular waveguide 2 are shown by waves 8 and 9, respectively. Wave 8 is an incident input wave containing the $TE_{01}$ mode and wave 9 is a coupled wave of the $TE_{10}$ mode which is produced in waveguide 2 by coupling the energy from the wave in waveguide 1. As can be seen from the representations of waves 8 and 9, shown in FIG. 1, wave 9 has twice the wavelength of wave 8. It should also be noted that the periodicity of the group of apertures 3 coincides with the beat wavelength of waves 8 and 9. In order to obtain proper transition of the desired mode of wave propagation, the coupling apertures can only be provided in selected parts of the available coupling region between the abutting surfaces of the two waveguides. For this reason, a long length of coupler is required so as to couple a sufficient amount of energy from incident wave 8 to form coupled wave 9. The length of coupler is generally on the order of 1.5 meters and due to such length tends to be lossy.

Figure 2:
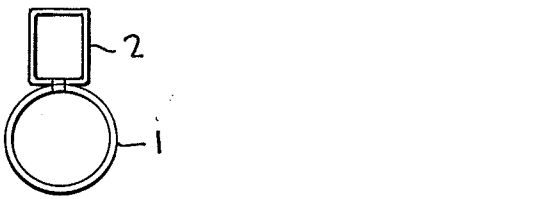
FIG. 2 PRIOR ART
FIG. 2 is a cross sectional view of the waveguide coupler illustrated in FIG. 1.

Furthermore, in utilizing such a coupling arrangement as shown in FIG. 1, it is necessary that the circular waveguide has a cross-sectional area fairly close in size to that of the rectangular waveguide. The relationship between the cross sectional areas of the two waveguides is shown in FIG. 2. Consequently, while circular waveguides having large cross sectional areas are generally utilized for transmission purposes, it is necessary for such coupling purposes to transfer the waves to a small circular waveguide at the location of the coupling. The transfer of the waves within the circular waveguide increases the attenuation thus reducing the amount of coupled energy which can be obtained.

Figure 3:
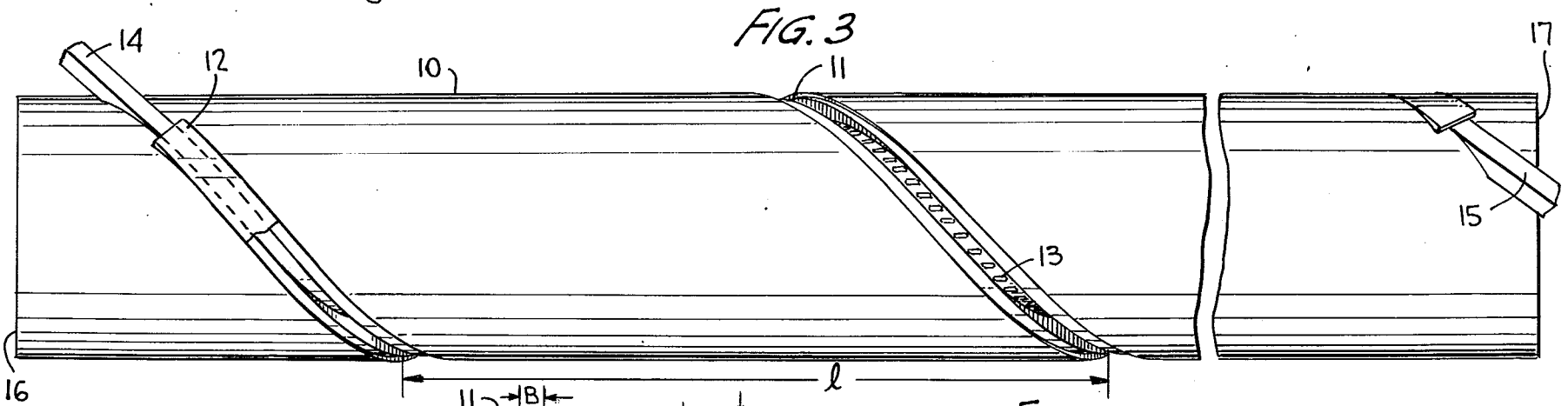
FIG. 3 is a perspective side view of a waveguide coupler in accordance with the present invention for coupling the magnetic fields of electromagnetic waves between a rectangular waveguide and a circular waveguide.

In order to provide a more efficient waveguide system, it has been found, in accordance with the present invention, to be necessary to both reduce the length of the coupler and also to avoid the necessity of utilizing a circular waveguide having a small cross sectional area. A waveguide coupler which achieves this criteria is provided in accordance with the present invention as shown in FIG. 3. This waveguide coupler can be utilized for coupling between the $TE_{no}$ mode of the rectangular waveguide and the $TE_{mn}$ modes of the circular waveguide. In the preferred embodiments, however, coupling is carried out between the $TE_{10}$ mode of the rectangular waveguide and the $TE_{01}$ mode of the circular waveguide.

Figure 5:
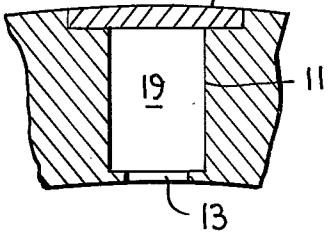
FIG. 5 is a sectional view of a portion of the waveguide coupler in accordance with the present invention as shown in FIG. 3.

A circular waveguide 10 is provided with a groove 11 which travels around the outer wall of waveguide 10 along a helical path. A thin piece of metal 12 is held in contact with the outer wall of waveguide 10 so as to cover groove 11, as shown in FIGS. 3 and 5. Metal covering 12 provides a good rf seal with the interface of circular waveguide 10 so that effectively a rectangular waveguide 19 is formed along the helical path formed around circular waveguide 10.

Figure 6:
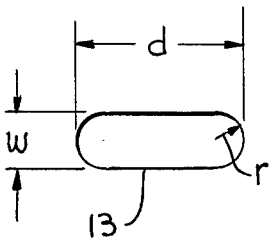
FIG. 6 is a diagrammatic view of a coupling aperture utilized in the waveguide coupler shown in FIG. 3.
Figure 7:
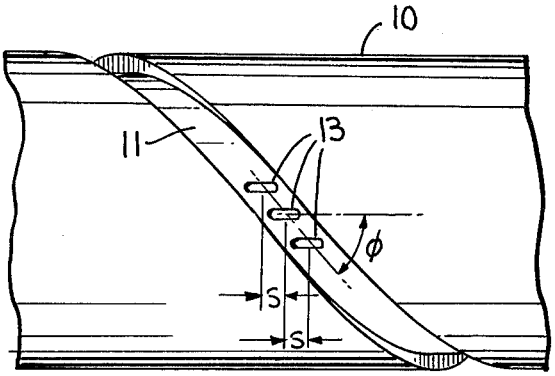
FIG. 7 is a side elevational view of a portion of the waveguide coupler shown in FIG. 3.

A plurality of coupling apertures 13 are provided along the bottom wall of groove 11 in circular waveguide 10. These coupling apertures have a slotted or oval formation as shown in FIG. 6. The slots are aligned with their major axes extending parallel to the longitudinal axis of circular waveguide 10, as shown in FIG. 7. The length of coupling aperture 13 is $d$, the width $w$ and the radius of the arcuate ends $r$. The radius $r$ is equal to $w/2$. With utilizing such a coupling aperture, the majority of the coupling field extends in the longitudinal direction. In this manner, the coupling arrangement discriminates against $TM_{mn}$ modes in the circular waveguide.

Discrimination against $TE_{mn}$ modes other than the desired $TE_{on}$ mode can be provided by phase mismatching due to the differences in the phase velocities of the various modes and by phase mismatching due to the selected helix angle.

Coupling apertures 13 are spaced apart in the axial direction of circular waveguide 10 by a distance $s$, which is approximately equal to a quarter wavelength of the wave to be supported by the circular waveguide and from which energy is to be coupled. The coupling apertures are spaced apart in the helical direction by a distance approximately equal to a quarter of the wavelength of the wave to be supported in helically wrapped rectangular waveguide 19.

The input port of rectangular waveguide 19 is coupled to a rectangular waveguide 14. Similarly the terminal port of waveguide 19 is coupled to another rectangular waveguide 15. Groove 11 at both the input and terminating ports has its depth tapered so as to be able to receive waveguides 14 and 15. In turn, circularly sectioned length of waveguide 10 has an input port 16 and an output port 17.

In operation, although the electromagnetic waves propagated in waveguides 10 and 19 have different phase velocities, the phase velocities of the two waveguides will be matched in the axial direction, at a predetermined frequency due to the greater path length of rectangular waveguide 19. Thus, energy from an incident electromagnetic wave possessing the $TE_{01}$ mode as the dominant mode at input port 16 can be coupled into rectangular waveguide 19 via coupling apertures 13 so as to produce a coupled electromagnetic wave. The frequency at which this coupling occurs is dependent upon the shape, dimension and positioning of coupling apertures 13. A $TE_{10}$ mode wave is thereby produced within rectangular waveguide 19 at output port 15. Alternatively, it is also possible to take an electromagnetic wave fed in through input port 14 of rectangular waveguide 19 and couple such wave into circular waveguide 10 so that a wave is obtained at output port 17.

The helical path to be traveled by rectangular waveguide 19 has a helix angle given by the following formula:

$$\theta = \cos^{-1} \frac{v_{p1}}{v_{p2}} \tag{6}$$

where $v_{p1}$ is the phase velocity of the mode to be coupled from circular waveguide 10 and $v_{p2}$ is the phase velocity of the mode to be coupled into rectangular waveguide 19 at the design frequency. The angel $\theta$ of the helix and correspondingly the dimensions of coupling apertures 13 may vary with the axial distance so that a broad band of frequencies may be converted from the $TE_{10}$ mode of operation or vice versa.

The operation of the coupler is primarily described with respect to coupling to the dominant $TE_{01}$ mode of operation in the circular waveguide. By appropriately selecting the shapes and dimensions of the slots, however, the angle of the helix and the pitch of the helix $l$, it is possible to provide coupling into any $TE_{mn}$ mode of operation within the circular waveguide.

During utilization of the coupler, there has been found to be a phase shift, which is caused by the coupling apertures. This phase shift causes a mismatching in the phase relationship of the coupled waves. This can be taken into consideration and corrected by appropriately adjusting the pitch of the helix. Thus, while the theoretical equation for the pitch is given above by formula (4), this pitch can be modified so as to compensate for the phase shift, $\epsilon$ (in radians). The phase shift $\epsilon$ is taken into consideration in the following formula:

$$\cos \theta = \frac{(f_o^2 - f_{c2}^2)^{1/2}}{(f_o^2 - f_{c1}^2)^{1/2} - (\epsilon/2\pi) \times (c/s)} \tag{7}$$

Consequently, the pitch with an appropriate correction factor included for compensating for the phase shift is given by the following formula:

$$l = \frac{\pi (D + A + 2T)}{\tan \theta} \tag{8}$$

Figure 4:
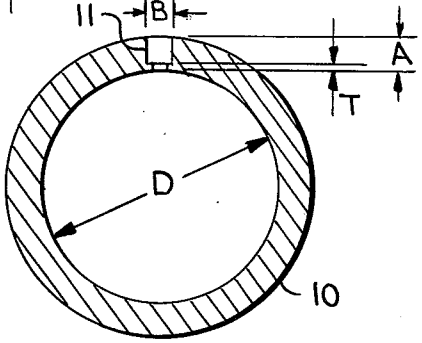
FIG. 4 is a cross-sectional view of the circular waveguide utilized in accordance with the coupling arrangement of the present invention.

In the above equations, the variables are as follows:

$f_o$ = coupler design frequency
$f_{cl}$ = cutoff frequency for $TE_{on}$ mode in the circular waveguide
$f_{c2}$ = cutoff frequency for the $TE_{10}$ mode in the rectangular waveguide
$c$ = free space velocity of light in air
$s$ = spacing of coupling aperture
D = diameter of circular waveguide
A = wide dimension of rectangular waveguide
B = narrow dimension of rectangular waveguide
T = thickness of the metal wall between circular and rectangular waveguides The last five of the above variables are illustrated in FIGS. 4 and 7 of the drawings.

When the phase shift $\epsilon$ equals 0, then the equation for the pitch of the helix reduces to the initial equation. The phase shift can be calculated within 5–10 percent by using known formulae for the electromagnetic fields in each waveguide and for the coupling strength of an aperture when corrected for resonance effects and the effect of the wall thickness T between the two waveguides.

The mode of the circular waveguide with which coupling is to desirably occur is generally the $TE_{01}$ mode. For this reason, it is desirable to minimize the power coupled into the other $TE_{on}$ modes. Because of the different phase velocities of the $TE_{01}$, $TE_{02}$ and higher $TE_{on}$ circular waveguide modes, when the rectangular $TE_{10}$ mode is matched to the $TE_{01}$ mode with the helical waveguide coupler, the other $TE_{on}$ modes will not be phase matched and hence very little energy will be coupled with such modes. A specific example is in the formation of a coupler for coupling between a WR-28 rectangular waveguide to a 60mm circular waveguide, $TE_{01}$ mode. The design frequency for such a coupler is 35.1GHz for the $TE_{01}$ mode which requires a 12.34 inch pitch for the helical path. Since with such an arrangement, the $TE_{02}$ mode is matched at 32.4GHz and the $TE_{03}$ mode at 27.9GHz, these modes are not matched with the helical coupler.

The coupling curve has a peak at the frequency where the $TE_{10}$ rectangular mode is phase matched to the $TE_{On}$ circular mode. Then, the phase difference between the apertures $\gamma$ as given by the following formula is equal to zero.

$$\gamma = \beta_1 \cdot s - [\beta_2 \cdot s / \cos \theta + \epsilon (f)] = 0 \tag{9}$$

with $$\beta_1 = 2\pi (f^2 - f_{cl}^2)^{1/2} / c \tag{10}$$

and $$\beta_2 = 2\pi (f^2 - f_{c2}^2)^{1/2} / c \tag{11}$$

where, $\beta_1$ is the propagation constant (radians per unit length) for the $TE_{on}$ circular waveguide mode, $\beta_2$ is propagation constant for the rectangular waveguide mode, $s$ is the aperture spacing as shown in FIG. 7 and $\theta$, $c$, $f_{c1}$ and $f_{c2}$ are the same as previously defined above. The frequency dependency of the aperture phase shift, $\epsilon (f)$, has to be taken into account. At some frequencies above and below the frequency of the peak coupling there will be a minimum coupling. The frequency at which this occurs can be adjusted by changing the number of coupling holes, thereby further minimizing the coupling of the other modes.

For a coupler designed for the $TE_{01}$ mode to minimize the coupling of another $TE_{on}$ mode at the design frequency, $f_o$, the number, N, of coupling apertures is chosen so that:

$$N\gamma = \pm 2\pi \cdot M, \; M = 1, 2, 3 \ldots \tag{12}$$

where $\gamma$ is evaluated for the $TE_{on}$ mode and at the design frequency $f_o$.

Although the above equations take into account the perturbations introduced by the coupling apertures, the manufactured couplers have an error of up to 1 percent in the frequency at which peak coupling occurs. This error can be compensated for by machining the outer diameter of the cylinder in which the helically wrapped waveguide is formed. This machining process decreases the width A of the rectangular waveguide and consequently increases the cutoff frequency of the $TE_{10}$ mode in the rectangular waveguide. This effect can be seen from the following equation (same as equation (3) above) which presents the relationship between the rectangular waveguide width A and the cutoff frequency $f_{c2}$ $$f_{c2} = c/(2 \cdot A)$$

An increase in the cutoff frequency of the rectangular waveguide correspondingly causes an increase in the frequency at which the peak coupling occurs. Accordingly, the couplers are constructed so that any error in the peak frequency is below the desired frequency.

Figure 8:
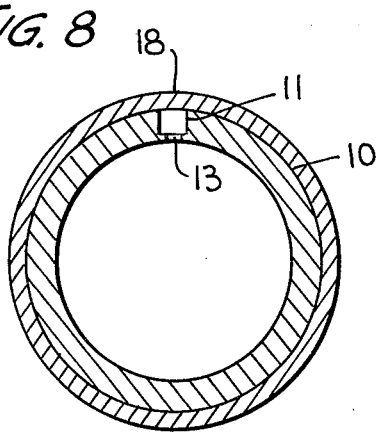
FIG. 8 is a cross-sectional view of the modified embodiment of the waveguide coupler in accordance with the present invention.

A modified embodiment of the waveguide coupler of the present invention is illustrated in FIG. 8. In this embodiment, instead of placing a metal plate 12 over groove 11 for forming rectangular waveguide 19, a second circular tube 18 is utilized. Tube 18 is either made of metal or has a metal inner surface so as to form a good rf seal at the top of groove 11 for constituting the rectangular waveguide.

Figure 9:
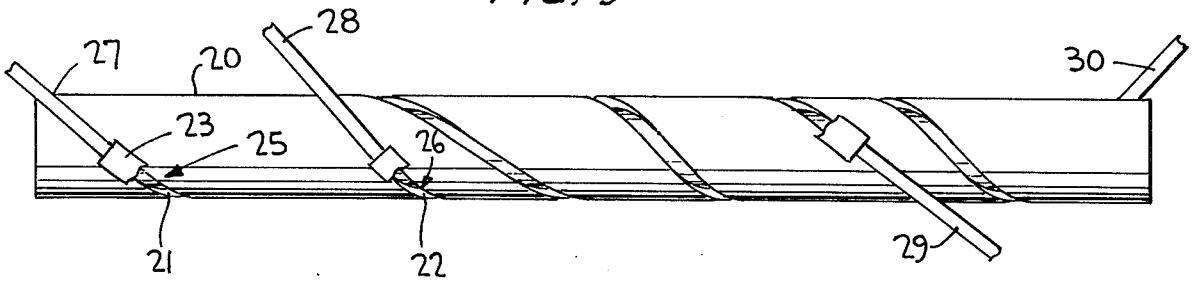
FIG. 9 is a perspective side view of a sequential band separator utilizing the waveguide coupler of the present invention.

One potential application which can be made of the helical waveguide coupler is in the formation of a sequential band separator for coupling a plurality of bands of frequencies between separate rectangular waveguides and a single circular waveguide. An arrangement of the waveguide coupler for such an operation is illustrated in FIG. 9. As shown, a circular waveguide 20 is provided with grooves 21 and 22, each of which has an appropriate set of slotted coupling apertures. Metal plates 23 and 24 cover the top of grooves 21 and 22 so as to form rectangular waveguides 25 and 26. Waveguide 25 is coupled at its input port to a rectangular waveguide 27 and a its output port to a waveguide 29. Similarly retangular waveguide 26 is coupled at its input port to a rectangular waveguide 28 and its output port to a rectangular waveguide 30.

The operation of the sequential band separator is similar to that of the coupler previously described with respect to FIG. 3. Each of the rectangular waveguides, however, have a different angle $\theta$ and pitch $l$ for their helical path so that each serves to couple different bands of frequencies. The helices can be intertwined so as to provide a shorter overall length for the separator. If the helices are intertwined then parts of the adjacent bands of frequencies can be simultaneously coupled between the rectangular waveguide and the circular waveguide.

It is noted that the above description and the accompanying drawings are provided merely to present exemplary embodiments of the present invention and that additional modifications of such embodiments are possible within the scope of this invention without deviating from the spirit thereof.

I claim:

1. A waveguide coupler for coupling energy between two lengths of waveguide through a coupling of their longitudinal magnetic fields, each length of waveguide being capable of supporting electromagnetic waves having a phase velocity different to the phase velocity of the waves supported by the other, the waveguide coupler comprising:

a circularly sectioned length of waveguide shaped and dimensioned to support a $TE_{mn}$ mode of wave propagation;

a further length of waveguide shaped and dimensioned to be capable of supporting a different order mode of wave propagation, said further length being capable of supporting waves having a higher phase velocity than said circularly sectioned length of waveguide and being helically wrapped around the outside of said circularly sectioned length of waveguide such that the magnetic fields of the electromagnetic waves are coupled between said circularly sectioned length and said further length; and, a plurality of apertures being provided along the contacting helical path between said circularly sectioned length of waveguide and said further length of waveguide such that said apertures open into the interior of both of said lengths of waveguide so as to enable coupling of energy between said two lengths of waveguide.

2. A waveguide coupler as defined in claim 1, wherein said circularly sectioned length of waveguide is shaped and dimensioned to support a $TE_{on}$ mode of wave propagation and said further length of waveguide has a rectangular cross section with one of its narrower walls contacting the outside wall of said circularly sectioned length of waveguide.

3. A waveguide coupler as defined in claim 2, wherein said circularly sectioned length of waveguide supports a $TE_{01}$ mode of wave propagation and said rectangular length of waveguide supports a $TE_{10}$ mode of wave propagation.

4. A waveguide coupler as defined in claim 3, wherein said coupling apertures are spaced apart in the axial direction of said circularly sectioned length of waveguide by a distance substantially equal to an odd multiple of a quarter of the wavelength of the wave to be supported by said circularly sectioned length of waveguide and are spaced apart in the direction of the helix by a distance substantially equal to an odd multiple of a quarter of the wavelength of the wave to be supported in the helically wrapped rectangular length of waveguide.

5. A waveguide coupler as defined in claim 4 wherein said circularly sectioned length of waveguide is provided with a rectangular shaped groove in its outer wall, said groove traversing said circularly sectioned length of waveguide along a helical path and a metal plate is provided to cover said groove so that said groove and said metal plate form said rectangular length of waveguide in contact with said circularly sectioned length of waveguide.

6. A waveguide coupler as defined in claim 5 wherein the depth of said groove is tapered at its initial and terminating ends so as to be of a greater depth at such ends, said initial and terminating ends being capable of receiving separate rectangular sectioned lengths of waveguide for coupling with said rectangular sectioned length of waveguide formed within said circularly sectioned length of waveguide.

7. A waveguide coupler as defined in claim 3 wherein said circularly sectioned length of waveguide is provided with a rectangular-shaped groove in its outer wall, said groove traversing said circularly sectioned length along a helical path, and a circular tube is placed around a portion of said circularly sectioned length of waveguide so as to cover said groove so that said covered groove constitutes said rectangular sectioned length of waveguide.

8. A waveguide coupler as defined in claim 3 wherein said coupling apertures are approximately oval in shape with their major axes extending in a direction parallel to the longitudinal axis of said circularly sectioned length of waveguide.

9. A waveguide coupler as defined in claim 3 wherein the length of the contacting portions of said circularly sectioned length of waveguide and said rectangular length of waveguide, and the number of coupling apertures are selected such that said waveguide coupler discriminates against the coupling of modes other than the $TE_{01}$ mode in said circularly sectioned length of waveguide.

10. A waveguide coupler as defined in claim 3 wherein the angle of the helical path traversed by said rectangular length of waveguide around said circularly sectioned length of waveguide is the angle $\theta$ as given by the following formula:

$$\theta = \cos^{-1}\frac{V_{p1}}{V_{p2}}$$

where $V_{p1}$ is the phase velocity of the mode to be coupled from said circularly sectioned length of waveguide and $V_{p2}$ is the phase velocity of the mode to be coupled into said rectangular length of waveguide.

11. A waveguide coupler as defined in claim 5 wherein the pitch $l$ of the helical path of said rectangular waveguide is given by the following formula:

$$l = \frac{\pi (D + A + 2T)}{\tan \theta}$$

where $$\cos \theta = \frac{(f_o^2 - f_{c2}^2)^{1/2}}{(f_o^2 - f_{c1}^2)^{1/2} - (\epsilon/2\pi) X (c/s)}$$

and $\epsilon$ is the phase shift due to the shape of said coupling apertures $f_o$ is the coupler design frequency $f_{c1}$ is the cutoff frequency for $TE_{on}$ mode in said circular waveguide $f_{c2}$ is the cutoff frequency for $TE_{10}$ mode in said rectangular waveguide $c$ is free space velocity of light in air $s$ is the spacing of said coupling apertures $D$ is the diameter of said circular waveguide $A$ is the wide dimension of said rectangular waveguide $T$ is the thickness of the wall between said circular and rectangular waveguides.

12. A waveguide coupler as defined in claim 11 wherein the number N of coupling apertures is given approximately by the following formula:

$$N = \frac{2\pi M}{\gamma}$$

where $M = 1, 2, 3 \ldots$ $\gamma = \beta_1 s - [(\beta_2 s/\cos \theta) + \epsilon (f)]$ $\beta_1 = 2\pi (f^2 - f_{c1}^2)^{1/2} / c$ $\beta_2 = 2\pi (f^2 - f_{c2}^2)^{1/2} / c$ *and*

$f_{c1}$ = cutoff frequency of undesired $TE_{on}$ circular mode.

13. A waveguide coupler as defined in claim 5 wherein the cutoff frequency $f_{c2}$ for the $TE_{10}$ mode in said rectangular waveguide is given by the following formula:

$$f_{c2} = c/(2 \cdot A)$$

where $A$ is the wide dimension of said rectangular waveguide; and said waveguide coupler can be turned so as to achieve maximum coupling of energy between said waveguides at a desired frequency by adjusting the wide dimensioned dimension A of said rectangular waveguide.

14. A sequential band separator for coupling a plurality of bands of frequencies from a circular waveguide comprising a waveguide coupler as claimed in claim 3 together with at least one additional length of waveguide having a rectangular shaped cross section, said additional length of waveguide also being helically wrapped around the outside of said circularly sectioned length of waveguide such that its narrow wall contacts said circularly sectioned length with the angle of the helical path traversed by said additional length being different from the angle traversed by the helical path of said rectangular length of waveguide, such that said additional length and said rectangular length of waveguides each couple different bands of frequencies, and a plurality of apertures being provided in the contacting portions of said additional length of waveguide and said circularly sectioned length of waveguide.

15. A sequential band separator as defined in claim 14 wherein the helices of said rectangular length of said additional length of waveguides are, intertwined such that for a predetermined axial length of said circularly sectioned length of waveguide, portions of adjacent bands of frequencies are simultaneously coupled out with said circularly sectioned length of waveguide.

16. A sequential band separator as defined in claim 14 wherein said coupling apertures are spaced apart in the axial direction of said circularly sectioned length of waveguide by a distance substantially equal to a quarter of the wavelength of wave to be supported by said circularly sectioned length of waveguide and from which energy is to be coupled and are spaced apart in each helical direction by a distance substantially equal to a quarter of the wavelength of the wave to be supported in the respective helical lengths of waveguide.

* * * * *